US005743123A

United States Patent [19]

Yamamoto et al.

[11] Patent Number: 5,743,123

[45] Date of Patent: Apr. 28, 1998

[54] METHOD OF THREAD ROLLING A SCREW SHAFT

[75] Inventors: Masatoshi Yamamoto; Hiromasa Hosono, both of Kiryu, Japan

[73] Assignee: Mitsuba Corporation, Kiryu, Japan

[21] Appl. No.: 792,222

[22] Filed: Jan. 31, 1997

[30] Foreign Application Priority Data

Feb. 1, 1996 [JP] Japan ..... 8-038876

[51] Int. Cl.[6] ..... B21H 3/06

[52] U.S. Cl. ..... 72/88; 470/10

[58] Field of Search ..... 72/88, 90, 469; 470/9, 10, 84, 85

[56] References Cited

U.S. PATENT DOCUMENTS 440,333 11/1890 Rogers ..... 72/469

2,183,688 12/1939 Olson ..... 72/88

2,314,390 3/1943 De Vellier ..... 72/90

FOREIGN PATENT DOCUMENTS 112841 4/1990 Japan ..... 72/88

*Primary Examiner*—Daniel C. Crane

*Attorney, Agent, or Firm*—Oliff & Berridge, PLC

[57] ABSTRACT

In a method of thread rolling a screw shaft, an inclining portion 1*c* is provided between a machining portion 1*a* of a screw shaft 1 and a non-machining portion 1*b* thereof as well as a taper portion 2*b* is formed to screw groove forming dies 2, by which a machining load concentrating at the thread rolling portion on the end of the dies adjacent a chuck can be reduced. With this method, the screw shaft can be thread rolled to have straightness of high quality.

2 Claims, 1 Drawing Sheet

METHOD OF THREAD ROLLING A SCREW SHAFT

BACKGROUND OF THE INVENTION

1. Field of the Invention

The present invention relates to a method of thread rolling a screw shaft used, for example, as a motor output shaft and the like.

2. Description of the Related Art

In general, many output shafts of motors and the like are composed of a screw shaft having a screw groove formed into the outer periphery thereof. As a method of machining the screw shaft, a conventional method of thread rolling presses a pair of screw groove forming dies against the outer periphery of the cylindrical screw shaft.

In the conventional method of thread rolling, as shown in FIG. 2, a chuck of a drive unit (not shown) is fixed to a non-machined portion 3*a* of a screw shaft 3 having a first diameter and dies 4 are pressed against a machining portion 3*b* of the screw shaft 3 having a second diameter smaller than the first diameter. In this case, however, a load produced during the thread rolling concentrates at a threading rolling portion 3*c* of the screw shaft 3 which is located at ends of the dies 4 adjacent the chuck possibly causing the threading portion 3*c* to become bent. Thus, there is a problem in that it is difficult to provide a screw shaft 3 with linearity of high quality after thread rolling. An object of the present invention is to solve this problem.

SUMMARY OF THE INVENTION

Taking the above circumstances into consideration, an object of the present invention in addressing the above problems is to provide a method of thread rolling a screw shaft to form a screw groove into a portion of an outer periphery of a cylindrical screw shaft by pressing screw groove forming dies against the portion of the outer periphery of the screw shaft. The method of thread rolling comprises the steps of providing the screw shaft with an inclining portion disposed between a machining portion having a small diameter and a non-machining portion having a large diameter and forming the screw groove to the machining portion of the screw shaft using the screw groove forming dies. The screw groove forming dies have teeth formed thereon to form the screw groove and a taper portion to be pressed against the inclining portion of the screw shaft during thread rolling. With this arrangement, a thread rolling load which conventionally concentrates at the ends of the dies adjacent the chuck can be received by the inclining portion of the screw shaft following the machining portion, so that the occurrence of the bending of the screw shaft can be reduced and straightness of high quality can be achieved to the screw shaft.

In the present invention, since the taper portion formed on the dies has an inclining angle that is larger than that of the inclining portion formed on the screw shaft, contact between the taper portion of the dies and the inclining portion of the screw shaft can be avoided when thread rolling commences and as a result of avoidance of excessive load added to the inclining portion of the screw shaft, the deformation of both machining and non-machining portions can be diminished, in contrast to conventional thread rolling where the inclining angle of the dies is the same as that of the screw shaft.

DESCRIPTION OF THE PREFERRED EMBODIMENT

Next, a preferred embodiment of the present invention will be described with reference to the drawings.

Figure 1:
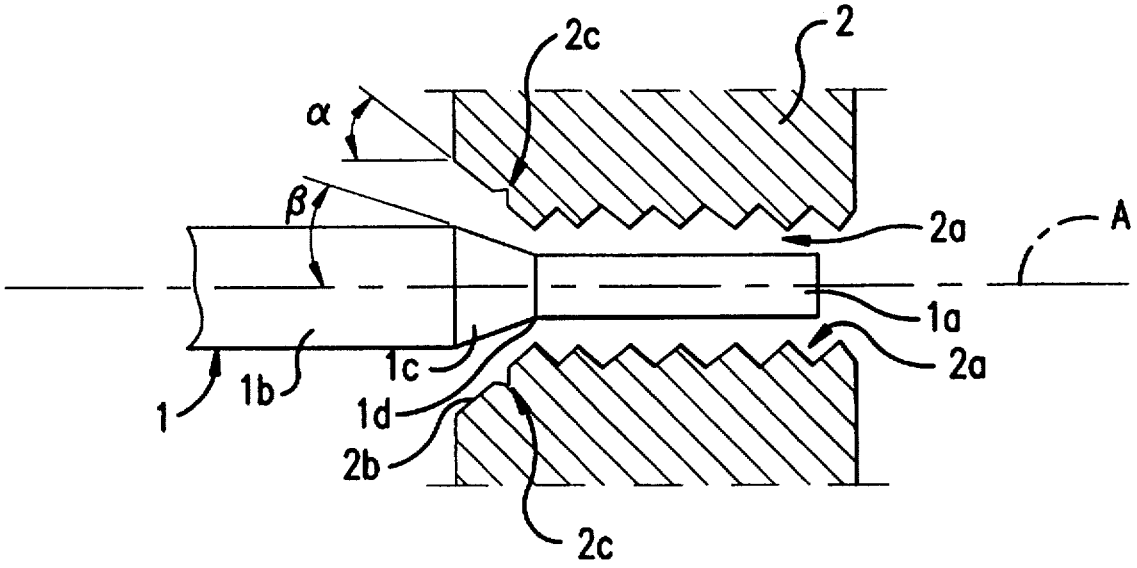
FIG. 1 is a side cross sectional view showing a screw shaft disposed within screw groove forming dies.
Figure 2:
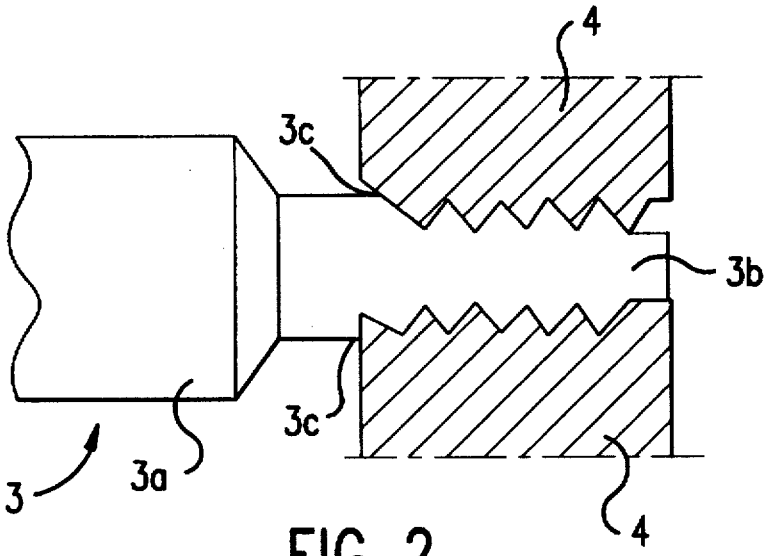
FIG. 2 RELATED ART
FIG. 2 is a side cross sectional view showing a conventional screw shaft disposed within conventional screw groove forming dies.

In FIG. 1, a cylindrical screw shaft 1 having a machining portion 1*a* with a small diameter to which a screw groove is thread rolled, a non-machined portion 1*b* with a large diameter which is fixed to a conventional chuck (not shown) connected to a conventional drive unit (also not shown) but to which no screw groove is thread rolled and an inclining portion 1*c* which is located between the machining portion 1*a* having the small diameter and the non-machined portion 1*b* having the large diameter. The screw shaft 1 includes an inclining shaft angle "P" relative to a longitudinal axis "A" of the screw shaft 1 so that the diameter thereof is gradually reduced from the non-machined portion 1*b* toward the machining portion 1*a*. A skilled artisan would appreciate that the large diameter of the non-machined portion 1*b* is larger relative to the small diameter of the machining portion 1*a*.

Also in FIG. 1, screw groove forming dies 2 include a teeth portion 2*a* to which teeth are defined to form the screw groove into the machining portion 1*a* as well as a die taper portion 2*b* also defined thereto which generally corresponds to the inclining portion 1*c* of the screw shaft 1. However, the taper portion 2*b* has an inclining die angle "$\alpha$" which is larger than the inclining shaft angle "$\beta$" of the inclining portion 1*c* ($\alpha>\beta$). In the preferred embodiment of the present invention, the inclining angle "$\beta$" of the screw shaft 1 is set to 13° and the inclining die angle "$\alpha$" of the dies 2 is set to 14.5°. Further, in this embodiment, partially thread rolling teeth 2*c* are also formed and extend to the taper portion 2*b* so that thread rolling can be carried out in the manner that the screw groove formed on the machining portion 1*a* of the screw shaft 1 is partially extended onto the inclining portion 1*c*.

When the screw groove is thread rolled into the screw shaft 1 in the preferred embodiment of the present invention as described above, the screw groove is formed in a manner that the dies 2 are pressed against not only the machining portion 1*a* having the small diameter but also the inclining portion 1*c* disposed between the machining portion 1*a* and the non-machined portion 1*b*. As a result, when it is assumed that the load produced during the thread rolling concentrates on the end of the dies 2 adjacent the chuck, the portion which receives the load is not the machining portion 1*a* but the inclining portion 1*c* which is stronger than the machining portion 1*a*. Thus, the machining portion 1*a* is prevented from being bent contrary to the prior art and the thus machined screw shaft has excellent linearity.

Furthermore, since the inclining die angle "$\alpha$" of the taper portion 2*b* of the dies 2 is larger than the inclining shaft angle "$\beta$" of the inclining portion 1*c* of the screw shaft 1 in the preferred embodiment of the present invention, the dies 2 are pressed against a boundary portion 1*d* between the inclining portion 1*c* and the machining portion 1*a* when they are pressed against the machining portion 1*a* at the initial stage of the thread rolling process. Then, as the thread rolling proceeds, the dies 2 are pressed against portions of the inclining portion 1*c* increasingly distant from the machining portion 1*a*. As a result, deformed material from the inclining portion 1*c* is discharged toward an upper side of the inclining portion 1*c* away from boundary portion 1*d*. In the practice of the invention, problems associated with excessive machining load can be avoided because there is a place to which the deformed material from the inclining portion 1*c* can be discharged. In conventional thread rolling, where inclining angles of dies and shaft are set at the same value, deformed material eventually has no place to flow, and excessive loading can result in the loss of the threads formed on the machining portion 1*a*.

Moreover, the partially thread rolling teeth 2*c* for thread rolling the screw groove are formed along the taper portion 2*b* of the dies 2 and therefore form the screw groove to a part of the inclining portion 1*c* continuous to the machining portion 1*a*. However, since the screw groove thread rolled here has a groove depth which is made shallower toward the chuck side of the screw shaft, where the shaft has a larger diameter, and the groove dissipates at approximately midway thereto, the load widely spreads over the inclining portion 1*c* in the thread rolling. Thus, partial concentration of the load at the end of the rolled screw groove on the chuck side is avoided. Consequently, the resulting screw shaft is straighter.

What is claimed is:

1. A method of thread rolling of a screw shaft for forming a screw groove into an outer periphery of a cylindrical screw shaft by pressing screw groove forming dies against the outer periphery of the screw shaft comprising the steps of:

providing the screw shaft extending along a longitudinal axis and having an inclining portion disposed between and connected to a machining portion having a small diameter and a non-machining portion having a large diameter relative to the small diameter, wherein the inclining portion inclines at an inclining angle from the machining portion to the non-machining portion relative to the longitudinal axis; and forming the screw groove into the machining portion of the screw shaft using the screw groove forming dies, the dies having teeth formed therein to form the screw groove and a taper portion for receiving the inclining portion in a manner that the taper portion presses against the inclining portion of the screw shaft and forms a taper angle relative to the longitudinal axis larger than the inclining angle during the thread rolling.

2. A method of thread rolling of a screw shaft according to claim 1, wherein the taper portion formed into the dies has teeth for forming the screw groove, the teeth extending approximately midway of the taper portion.

* * * * *